United States Patent [19]

Arnold et al.

[11] 4,164,345

[45] Aug. 14, 1979

[54] SAFETY CRADLE FOR TRANSFORMER REPAIR

[76] Inventors: William L. Arnold, 6131 W. Avalon Dr., Phoenix, Ariz. 85033; Harry M. Wilson, Jr., 2222 W. Sierra, Phoenix, Ariz. 85029

[21] Appl. No.: 874,851

[22] Filed: Feb. 3, 1978

[51] Int. Cl.[2] ..... B23Q 3/18

[52] U.S. Cl. ..... 269/69

[58] Field of Search ..... 269/17, 58, 61, 69, 269/71, 73; 214/1 Q

[56] References Cited

U.S. PATENT DOCUMENTS

| | | | |
|---|---|---|---|
| 1,469,734 | 10/1923 | Staley | 269/69 |
| 2,106,367 | 1/1938 | Vollmer | 269/73 X |
| 4,093,199 | 6/1978 | Hefner | 269/61 |

*Primary Examiner*—Robert C. Watson

*Attorney, Agent, or Firm*—Joseph H. Roediger

[57] ABSTRACT

A safety cradle for facilitating repair of pad-mounted electrical transformers wherein a cradle having a base and a back support is rotatably mounted on a frame. The transformer is placed on the base, secured in place and the cradle rotated 90 degrees so that the front surface of the transformer is horizontal and repairs may be readily made.

14 Claims, 4 Drawing Figures

SAFETY CRADLE FOR TRANSFORMER REPAIR

BACKGROUND OF THE INVENTION

This invention is directed to apparatus for receiving and supporting an electrical transformer which facilitates access to both the front of the transformer and the inside thereof.

Present practice in providing electrical service to new service areas has resulted in increasing installations of underground lines with the distribution transformers being mounted on a concrete pad. The shape of the pad-mounted transformer is generally a parallelipiped as contrasted with the pole-mounted cylindrical shaped transformer.A typical pad-mounted transformer has the approximate dimensions of 3 feet by 3 feet by 3 feet and often weighs in excess of three-quarters of a ton. Thus, a hoist is utilized in positioning, replacing and repairing the transformers.

The weight and size of the transformer has made it difficult to easily move the device and conduct a repair operation. Most of these pad-mounted transformers are characterized by the location of the access panel at the front of the transformer. The front-access to the interior coupled with oil-filling for insulation and cooling has required the transformer to be hoisted and then rotated by the repair-men to a position wherein the transformer front-access panel is an exposed horizontal surface. The operation normally requires two men to position the transformer for repair in addition to the hoist operator. Furthermore, access to other surfaces required the rotational operation to be repeated. Additional problems are encountered in situations wherein hollow cooling fins are provided at the back surface of the transformer.

The increasing use of pad-mounted transformers has generated a need for apparatus which can provide a work support for the transformer during repair. The present invention is directed to the provision of a transformer safety cradle wherein the transformer can be secured and positioned with the front-access surface in the horizontal position by a single individual. In addition, this invention can accommodate transformers with rear facing cooling fins and also provide work access to the bottom surface. Usage of the present invention for the repair of pad-mounted transformer has resulted in substantial savings in labor costs due to the reduced manpower requirement and substantially eliminates oil loss during repair.

SUMMARY OF THE INVENTION

This invention concerns safety apparatus for supporting an electrical transformer in an elevated position while permitting the transformer to be rotated so that the front access surface is horizontal for repair operations. The transformer safety cradle includes a transformer support structure having first and second support members orthogonally connected at their adjacent edges. During the loading of the transformer, the bottom surface thereof is received and supported by the first member.

A frame having first and second spaced upright members and a base member which rests on the ground is provided. The spaced upright members each have a bearing mounted thereon. The transformer support structure includes pivot shafts which are journalled in the bearings whereby the support structure is rotatably mounted in the frame. The pivot shafts are mounted on connectors located on either side of the support member and secured to the sides at regions near the exposed edges of the support members.

The safety cradle further includes first and second stop means affixed to the transformer support structure for engagement with the frame and to establish the rotational limits of the support structure thereby preventing rotation thereof greater than 90 degrees. Thus, the transformer can be rotated to the position wherein it is supported by the second support means and its front surface is horizontal to provide simplified work access and prevent oil leakage during repair.

Retaining means coupled to the support structure is also provided in order to maintain the transformer on the support structure during rotation and repair. In applications wherein the transformer has cooling fins located on the rear surface, the second support member is made to conform to the fins so that the transformer back surface may be received thereby and still provide the needed support after rotation to the second or work position.

Further features and advantages of the invention will become more readily apparent from the following detailed description of preferred embodiments thereof when viewed in connection with the accompanying drawings.

DESCRIPTION OF THE PREFERRED EMBODIMENTS

Figure 1:
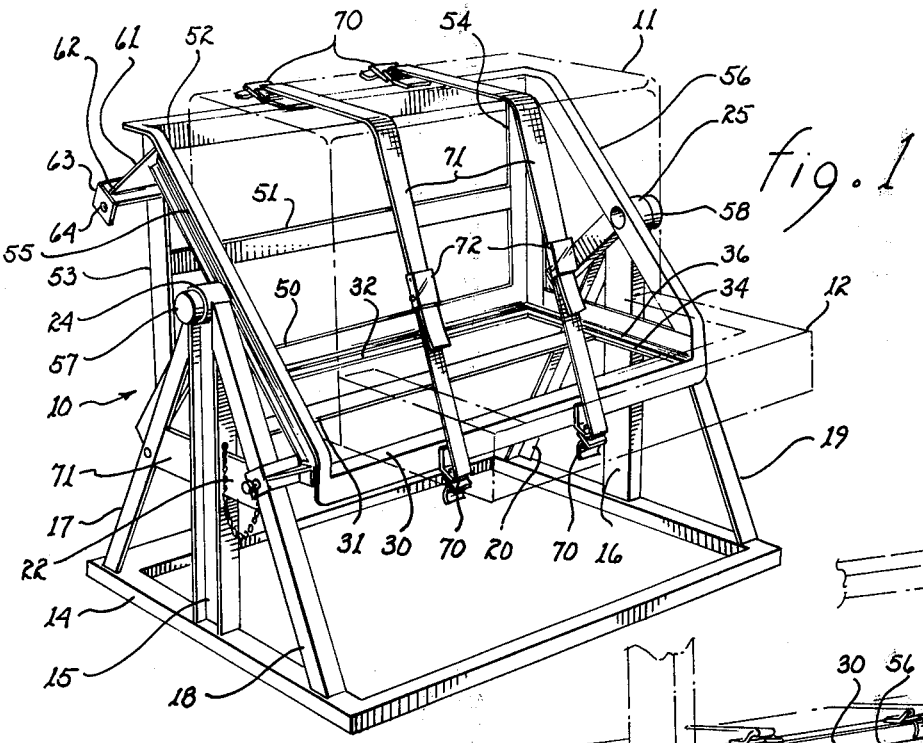
FIG. 1 is a front view in perspective of one embodiment of the invention.
Figure 2:
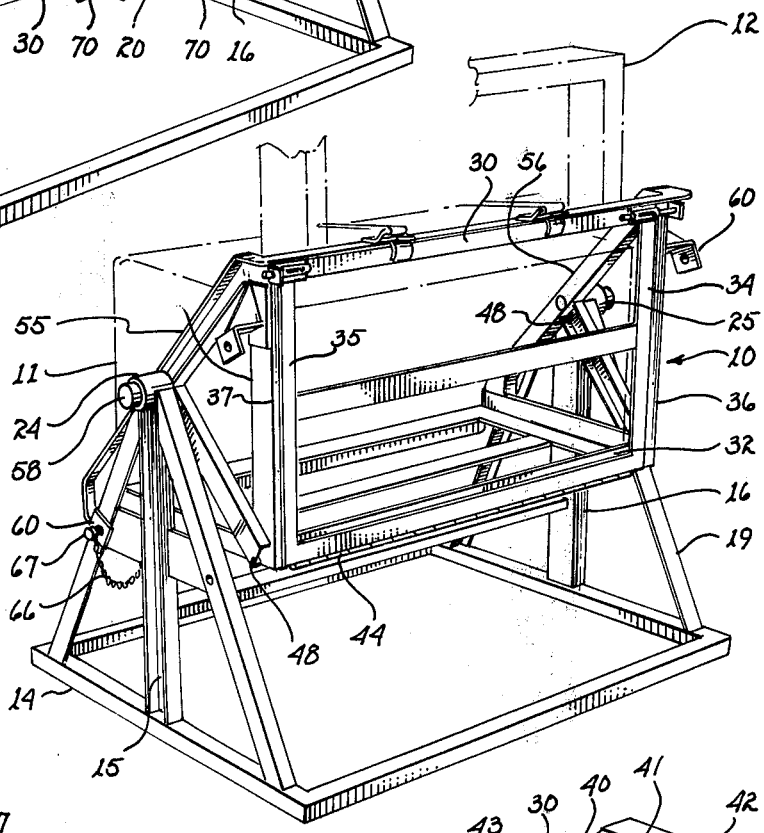
FIG. 2 is a view in perspective taken from the rear of the embodiment of FIG. 1 with a pad-mounted transformer in a repair position.

Referring now to the embodiment shown in FIGS. 1 and 2, the transformer safety cradle 10 is shown supporting a conventional pad-mounted electrical transformer 11 in the loaded or first position as in FIG. 1 and in the repair or second position as in FIG. 2. The front surface of this type of transformer contains the external connectors and the front access panel (not shown) with a protective and stabilizing member 12 extending forwardly for contact with the concrete pad.

The transformer safety cradle 10 is provided with a generally rectangular supporting base 14 which rests on the basal surface or ground. At opposing sides thereof, first and second upright members 15 and 16 extend upwardly and terminate with bearings 24 and 25 respectively. First upright member 15 is provided with angle braces 17 and 18 affixed to the supporting base 14 at their lower ends. To impart rigidity to the structure, spacers 21 and 22 are located approximately midway on the upright member 15 and extend to the adjacent angular braces. The second upright member 16 is similarly supported by braces 19 and 20 and a pair of spacers.

The transformers support structure rotatably mounted in bearings 24 and 25 includes a first support member for receiving the transformer when it is hoisted into its initial position on the assembly. In FIG. 1, the first support member includes three parallel cross pieces 30, 31 and 32 affixed to end pieces 34 and 35. Adjacent end pieces 34 and 35 are frame members 36 and 37 respectively, shown more clearly in FIG. 2. The combination of crosspieces 30, 31, 32 and end pieces 34, 35 form an integral structure which is secured in position adjacent frame members 36 and 37 by the cooperation of bolts 40, curved receiving members 41 affixed to the opposing ends of crosspiece 30 and apertured flanges 42. As shown in more detail in FIG. 4, the insertion of the bolts through the flange aperture and the corresponding receiving member provide a planar surface for receiving the bottom surface of the transformer when it is hoisted into the first or initial position. The crosspiece 32 is supported by hinge 44 extending along its length. The hinge is affixed to frame member 50. Thus, the removal of pins 40 permits the ready access to the bottom of the transformer when the transformer is the second or work position as shown in FIG. 2.

Figure 4:
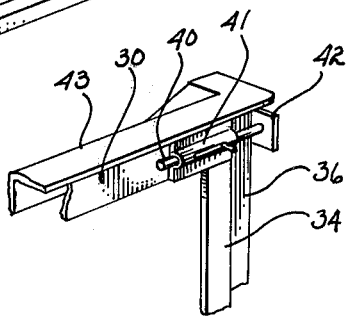
FIG. 4 is a view of the securing means for the bottom receiving surface of the assembly.

The second support member which receives the back of the transformer and provides support thereof when the transformer is in the work position of FIG. 2 is an integral structure which includes the three parallel crosspieces 50, 51 and 52 affixed at their ends to end pieces 53 and 54. End pieces 53 and 54 are formed of angle stock and thus have a flange thereon which reduces or limits the lateral movement of the transformer when it is in position on the safety cradle. It shall be noted that frame members 36 and 37 are also formed with flanges thereon to aid in limiting movement of the positioned transformer. The first and second support members are joined together by affixing the common areas of the end pieces together for example by welding. The hinge 44 secured to crosspieces 50 and 32 also provides support when the pins 40 are inserted as shown in FIG. 4.

To impart increased rigidity to the combination of the first and second support members, first and second side connectors 55 and 56 are affixed to the support members. Each support member extends between one end of crosspiece 30 and the corresponding end of crosspiece 52. Each side connector 55, 56 contains a pivot pin 57, 58 located intermediate its ends. The pivot pins are journalled in bearings 24, 25 to permit rotation of the transformer support structure so that the weight is transferred from one support member to the other. The pivot pins are located at the approximate midpoint of each side connector since the typical pad-mounted transformer has an approximately square end section and the resulting axis of rotation is proximate to the center of mass of the transformer. This reduces the effort required to rotate the transformer.

The limits for rotation of the transformer positioned in the support structure are established by the four stop members 60 each of which is affixed to an end of the crosspieces 30 and 52. Each pair of stop members is located to engage the corresponding angle braces 17, 18, 19, 20 when one of the support members is horizontal. As shown, the stop members are outwardly extending flanged members which include three parts. The first part 61 is a strengthening rib affixed to the support structure and extends outwardly normal to the structure. In addition, the long dimension of the rib 61 is normal to the surface of the angle brace that it is to engage. A flat contact member 62 is affixed to the edge of rib 61 and is angularly disposed so as to be parallel to the surface of the angle brace when in contact therewith. A downwardly extending flange 63 is located at the outward end of contact member 62. Each flange 63 contains a centrally located aperture 64 therein. When the support structure is rotated so that the contact member engages the surface of the corresponding angle brace, the flange extends downward along the outer surface of the angle brace so that the aperture 64 is in alignment with a corresponding aperture 65 in the angle brace. A pin 67 is then inserted into the aperture to lock the support structure and the transformer in position. As shown, the pin 67 is coupled to an upright member by a chain 66 to insure that the pin at each upright member is within the reach of the operator. This facilitates one-man operation of the assembly.

The crosspieces 30 and 52 in addition to side connectors 55 and 56 are each provided with a flange thereon to increase the strength of the support structure. In practice, the angle braces are made of angle iron and the upright members therebetween are formed by double angle iron as shown. Similarly, corner brace 48 provided between a side connector and the juncture of the first and second support members is formed of double angle iron, as shown, to provide increased support for the corresponding side connector at the location of the pivot pin.

The flange on crosspieces 30 and 52 provides the surface of the fasteners 70 of the means for insuring that the transformer is retained upon the support structure during rotation and when work is being performed thereon. The retaining means utilized in the embodiment shown includes a pair of flexible belts 71 secured at each end by clamps 70 through which the ends are threaded. The free ends are secured over the transformer when it is in position by buckles 72. The flexible belt and buckle are recognized to be but one of many types of retaining means that may be utilized.

Figure 3:
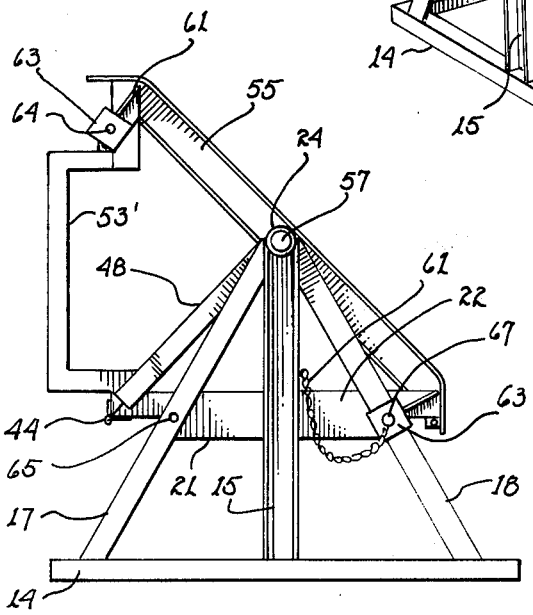
FIG. 3 is a side view of a second embodiment of the invention.

The embodiment shown in the side view of FIG. 3 is similar to the embodiment of FIGS. 1 and 2 with the exception that the second support member which receives the back of the transformer is made so that it can receive pad-mounted transformers having cooling fins extending therefrom. As shown in FIG. 3, the end pieces 53' and the corresponding 54' are provided with a centrally located recessed portion to accommodate the cooling fins if present. As a result, the second support member is provided with an offset portion extending thereacross and is not a planar surface as is the first support member. The crosspieces connecting the recessed end pieces in the embodiment of FIG. 3 are similar to those in the embodiment of FIGS. 1 and 2.

In operation, the assembly is in the position shown in FIG. 1 with the first support member providing a planar surface to receive the transformer as it is lowered into position. The locking pins 67 are inserted through the flange apertures into angle braces 18 and 19 to maintain the receiving surface in the horizontal or first position as shown. When the transformer is in the loaded position, the flexible straps 71 are buckled to insure that the transformer is maintained on the assembly. The pins are removed and the transformer and support structure are rotated 90 degrees to the second or work position as shown in FIG. 2. The pins are then inserted in the other angle braces to lock the assembly. The front surface of the transformer is now horizontal and the access panel may be removed or the external connnectors may be replaced without loss of the oil therein. If needed, the bolts 40 are removed from receiving members 41 and apertured flanges 42 to permit the central portion of the first support member to rotate outwardly on the hinge 44 and thereby provide access to the bottom surface of the transformer for surface refinishing or repair. At the completion of the repair operations, the transformer is returned to the loading position of FIG. 1 and removed from the assembly. The operation of the assembly requires but one operator in contrast with present industry practices wherein up to three men are utilized.

While the above description has referred to specific embodiments of the invention, it is recognized that many modifications and variations may be made therein without departing from the spirit and scope of the invention.

What is claimed is:

1. A transformer safety cradle which comprises:

(a) first support means adapted to receive and support the base of a transformer, said means having first and second edges;

(b) second support means adapted to receive and support one surface of the transformer, said second means having first and second edges with said first edge being connected to the second edge of said first means;

(c) first and second connectors, each of said connectors being located at one side of said first and second support means and extending between regions thereon proximate to the first edge of said first means and the second edge of said second means;

(d) a frame adapted for placement on a support surface, said frame including first and second upright members spaced to receive said support means and connectors therebetween;

(e) first and second pivot means for rotatably connecting each upright member to the adjacent connector whereby said first and second support means and the transformer received thereby can rotate relative to said frame; and (f) limit means affixed to at least one of said connectors for limiting rotation of said support means to between first and second positions, said first position corresponding to a loading position wherein the transformer is supported by said first support means and said second position corresponding to a work position wherein the transformer is supported by said second support means.

2. Apparatus in accordance with claim 1 further comprising locking means mounted on said frame for locking said first and second support means in said first and second positions when said locking means is actuated.

3. Apparatus in accordance with claim 1 wherein said limit means engages the frame when said first and second support means are parallel with the support surface for said frame.

4. Apparatus in accordance with claim 3 further comprising retaining means coupled to the first and second support means for securing the transformer thereon.

5. Apparatus in accordance with claim 4 wherein said first and second pivot means are coupled to the corresponding adjacent connector to define an axis of rotation of the transformer which is proximate to the center of mass of said transformer.

6. Apparatus in accordance with claim 5 wherein said first and second support means are orthogonally connected along adjacent edges whereby the transformer supported thereby rotates 90 degrees between the first and second positions.

7. Apparatus in accordance with claim 6 wherein said first support means comprises:

(a) a plurality of transverse support members extending parallel to the edge of said support means;

(b) inner support members secured to the ends of said transverse support members, and (c) means for rotatably mounting said transverse and inner support members in said first support means, the rotation of said support member when the transformer is in the second position providing access to the base of the transformer.

8. Apparatus in accordance with claim 7 wherein said second support means is provided with an offset portion extending thereacross to receive a non-uniform surface of the transformer.

9. Safety apparatus for supporting an electrical transformer in an elevated position while permitting rotation of the transformer in order to provide access to selected horizontal work surfaces thereof, said apparatus comprising:

(a) a frame having first and second spaced upright members and a base member, said base member being adapted for contact with a basal surface;

(b) first and second bearings located on the first and second upright members respectively;

(c) a transformer support structure extending between said spaced upright members and having first and second pivot shafts journalled in said first and second bearings respectively, said support structure having a first receiving member for supporting the base of the transformer and a second receiving member capable of receiving an adjacent surface of the transformer, said support structure being rotatably mounted in said frame;

(d) first and second stop members affixed to said support structure for engagement with the frame, said stop members being spaced on said support structure to prevent rotation thereof greater than 90 degrees; and (e) retaining means coupled to said support structure for maintaining the transformer therein during rotation of the support structure and transformer rotation thereof causing said second receiving member to support the transformer and providing an additional horizontal work surface thereon.

10. Apparatus in accordance with claim 9 wherein the first receiving member of the support structure is a planar surface for receiving the transformer base and the second receiving member of said support structure substantially conforms to an adjacent surface of the transformer.

11. Apparatus in accordance with claim 10 wherein the first receiving member of the support structure contains a section hinged thereto to provide access to the base of the transformer.

12. Apparatus in accordance with claim 11 wherein said first and second pivot shafts of the transformer support structure provide an axis of rotation that is proximate to the center of mass of the transformer.

13. Apparatus in accordance with claim 12 further including locking means mounted on said frame for locking said transformer support structure in the rotational positions defined by the first and second stop members.

14. Apparatus in accordance with claim 13 wherein said frame includes first and second pairs of angle braces, each of said pairs extending between the corresponding upright member and the base member, at least one of said pairs engaging the stop means and containing the locking means thereon.

* * * * *